United States Patent [19]

Guerton et al.

[11] 4,158,282

[45] Jun. 19, 1979

[54] TWISTER MECHANISM WITH ELASTIC PART

[75] Inventors: Jean-Pierre Guerton, Maisons Alfort; Jean Waleckx, Villebon sur Yvette; Jean-Michel Monville, Paris, all of France

[73] Assignee: SKF Compagnie d'Applications Mecaniques, Clamart, France

[21] Appl. No.: 882,513

[22] Filed: Mar. 1, 1978

[30] Foreign Application Priority Data

Mar. 4, 1977 [FR] France ..... 77 06419
Feb. 15, 1978 [FR] France ..... 78 04321

[51] Int. Cl.[2] ..... D01H 7/86
[52] U.S. Cl. ..... 57/58.72; 57/58.74
[58] Field of Search ..... 57/58.72–58.81

[56] References Cited

U.S. PATENT DOCUMENTS

| | | | |
|---|---|---|---|
| 2,521,601 | 9/1950 | Planet | 57/58.72 |
| 2,541,541 | 2/1951 | Pellat-Finet et al. | 57/58.72 |
| 2,587,758 | 3/1952 | Pellat-Finet et al. | 57/58.72 |
| 2,873,570 | 2/1959 | Sage | 57/58.72 |
| 3,296,787 | 1/1967 | Maurin | 57/58.72 X |

*Primary Examiner*—John Petrakes
*Attorney, Agent, or Firm*—Beveridge, DeGrandi, Kline & Lunsford

[57] ABSTRACT

A double-twist twister mechanism includes a pair of assemblies which rotate about oblique intersecting axes, support a nonrotating spool carrier and have portions extending through each other. The assemblies are connected together for concurrent rotation by an external elastic member which is passable over the spool carrier into engagement with concentrically arranged fasteners on both assemblies.

11 Claims, 8 Drawing Figures

1
I
I
III
III
36
36
36
34
22
9
12
34
40
28
22
29

TWISTER MECHANISM WITH ELASTIC PART

The invention refers to double-twist twister spindles having convergent axes.

It is known that in this type of twister the yarn unwinds from a spool mounted on a spool carrier coaxial with a hollow spindle, then passes in through the open end of the spindle and thus passes through the spool in order to leave it into a radial yarn-guide integral with the spindle, after which it starts off again towards a fixed yarn-guide located on the prolongation of the axis of the spindle in order to be reeled up on a receiver spool. Thus each revolution of the spindle produces two turns of twist in the yarn on condition that the support for the spool is stationary in space. In order to fulfil this condition it is not possible to employ direct means of connection between this spool support and the frame in which the spindle is revolving, inasmuch as this spool support finds itself entirely encircled by the balloon formed by the yarn which is revolving with the spindle.

In order to ensure this immobility of the spool support the practice is known of employing a mechanism having convergent axes, in which the spool support is mounted to revolve by means of a rigid bearing on the spindle which in turn is revolving rigidly in the support, and to provide furthermore an assembly likewise revolving rigidly in the frame but about an axis making a certain angle with the axis of the spindle, this assembly likewise revolving in bearings located in a corresponding direction in the spool support. The latter thus finds itself immobilized by the fact that it cannot revolve about two axes. The revolving assembly is usually realized by means of a number of parts fastened to one another and of complex configuration. One of these parts is drilled with an aperture through which passes the lateral yarn-guide duct from the spindle, the assembly being able to revolve about the oblique axis at the same time as the spindle revolves about its own axis. However, in order to avoid jarring and vibration prejudicial to the mechanism for the high speeds of rotation employed for the spindle, it is necessary for the revolving assembly to be driven by the spindle in as homokinetic a manner as possible. For that purpose conventional homokinetic joints cannot be suitable because of their complexity, bulk and high cost and of the necessity of freeing the central passage in the spindle widely as well as the lateral passage in the yarn-guide duct which starts out perpendicularly to the spindle, generally from the point of convergence of the two convergent axes.

Joints are likewise known which are derived from the flexible joint or diaphragm type but of a complex form connected with their adaptation to the foregoing requirements. In addition, in the event of breakage of the elastic driving part its replacement necessitates complete dismantling of the mechanism. The aim of the invention is to produce a complete twister mechanism which comprises the two overlapping assemblies revolving each about an axis distinct from the other and an elastic driving part which is of simple execution and which enables its easy replacement without necessitating complete dismantling of the mechanism.

The invention is characterized by the fact that the centred assembly consists of a plate the base of which includes a circular bore and a central hub having a circular periphery which fits into the foregoing bore, with indentations in the plate and/or the hub which open out into the bore, fastening members being arranged either on the plate or on the arms of the hub in each of the remaining portions between the indentations and in the direction of the spool-carrier, that the offset assembly which revolves about an oblique axis consists of a tubular sleeve in one or more parts, which surrounds the spindle and is mounted in bearings upon the fixed support and upon the spool-carrier, and has a central expansion interrupted by as many indentations as the centred assembly, allowing to persist at the level of the said expansion only sectors which are located each in one of the indentations in the centred assembly, other fastening members being likewise arranged on these sectors, likewise in the direction of the spool-carrier, finally that the elastic coupling part has an annular form preferably polygonal, with apertures enabling its adaptation to the various fastening members of the centred assembly and of the offset assembly. A first variant upon the invention consists in producing the assembly centred upon the spindle in two parts, the yarn-guide plate being drilled with an axial bore with a certain number of notches opening into this axial bore, and a central hub the circular periphery of which fits exactly inside this bore and has indentations which correspond in number and position with the indentations in the plate, this hub in turn having a central bore thanks to which it is fitted onto the spindle, the plate as well as at least one of the arms of the hub having a radial opening constituting the yarn-guide and being connected with the axial yarn-passage in the spindle, whilst the offset assembly consists of a tubular sleeve which surrounds the spindle and is mounted in bearing upon the fixed support and upon the spool-carrier, and exhibits a central expansion, this expansion being notched by a number of indentations equal to the number of indentations in the plate, the portions of the expansion which lie between the indentations in the offset part as well as either the portions of the plate which lie between the indentations in the plate or the arms of the hub having each a fastener spur, all the fastener spurs being orientated towards the same face and receiving an electric annular part the perimeter of which is determined so as to enable it to be passed round the two bearings which correspond respectively with the two assemblies to the same side as this face. It will easily be understood that the tubular sleeve surrounding the spindle may, for example, for reasons of ease of obtaining rough parts, be made in two parts which are assembled definitely at the time of machining the races for the rolling parts or bearing surfaces for bearings.

Another variant upon the invention consists in a twister of the type called to mind above, in making the plate and its base as well as the central hub in one single piece or in an assembly of non-dismantlable parts, and making the offset assembly in two separable portions.

Another special feature of the invention lies for the two variants in the method of mounting and fitting of the whole of the mechanism to enable a maximum of accuracy to be obtained.

Other special features of the invention will become apparent from the description which is to follow of an embodiment taken as an example and illustrated in the drawing attached, in which.

Figure 1:
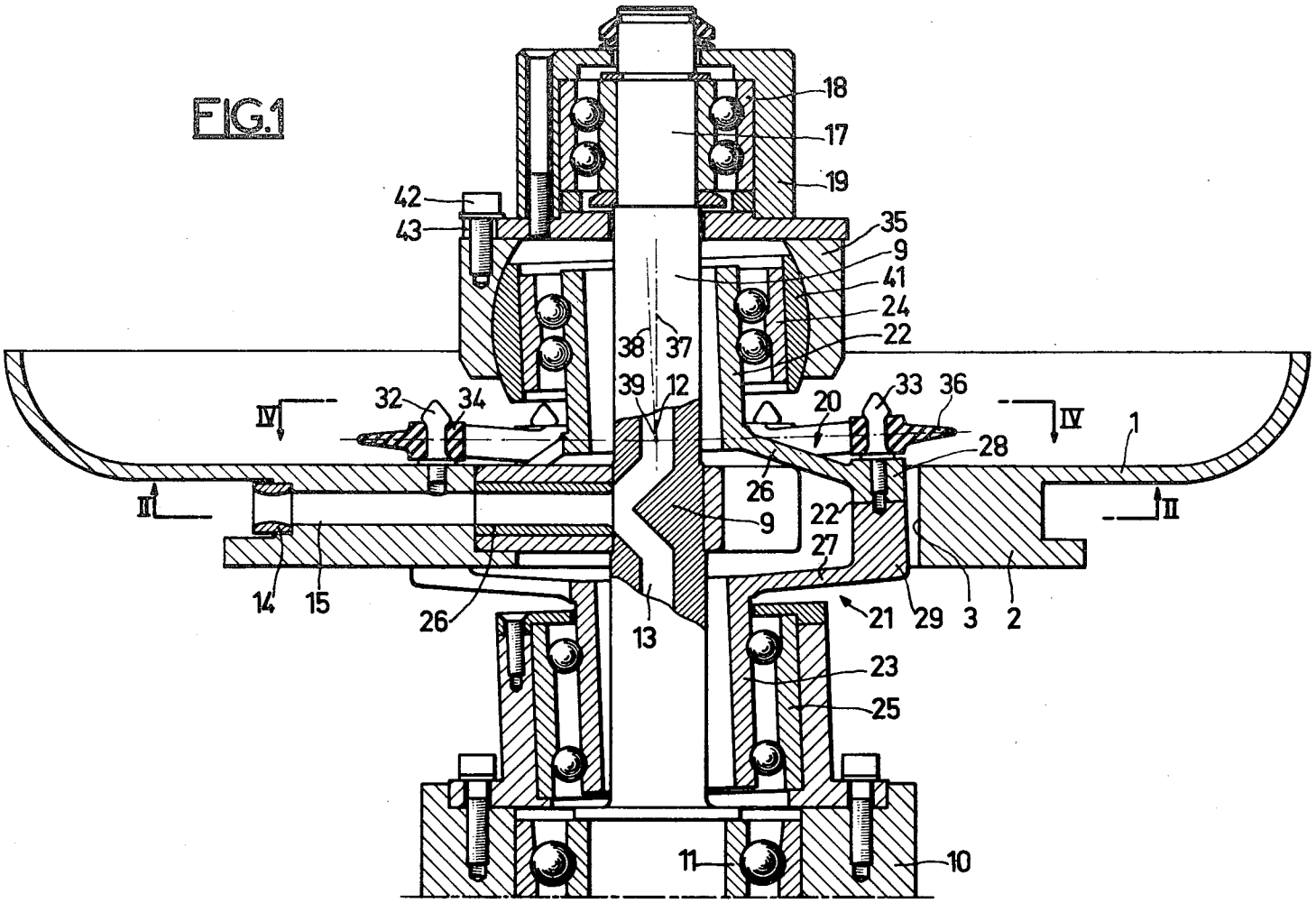
FIG. 1 represents the first variant in axial section along I—I in FIG. 4.
Figure 2:
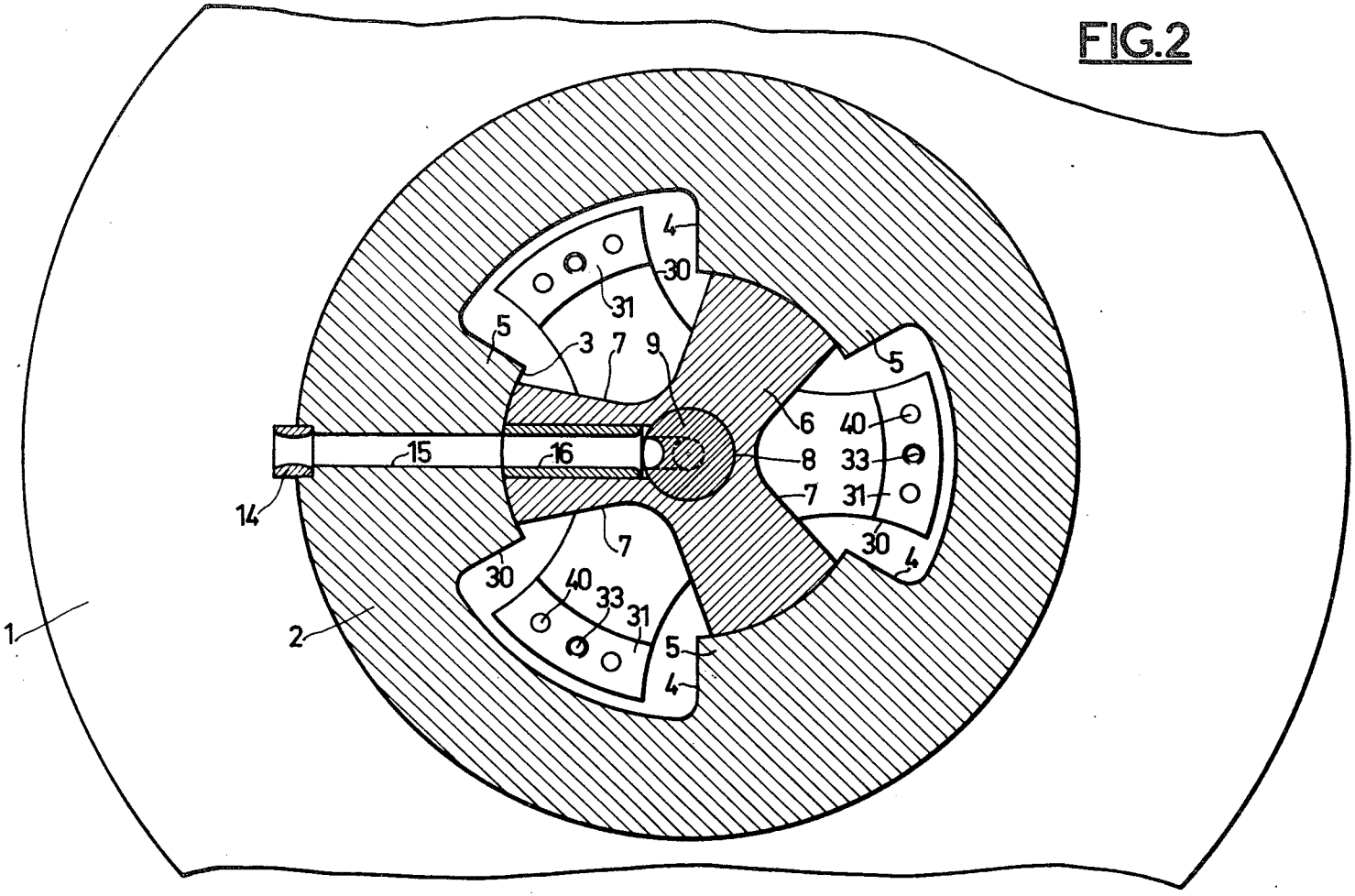
FIG. 2 is a cross-section along II—II in FIG. 1 of the same assembly assumed not offset.

As may be seen in FIGS. 1 and 2 the revolving assembly centred on the spindle includes a plate 1 intended for facilitating the formation of the balloon of yarn and equipped with a thick base 2 which is drilled with an accurately machined central bore 3. This same base 2 of the plate has three indentations 4 substantially the shape of circular sectors which open into the bore 3, leaving in existence only three sections of the bore 3, which constitute the tips of three internal teeth 5 which constitute the portions of the plate remaining between the indentations.

The centred assembly includes on the other hand a second part consisting of a central hub 6 the cylindrical periphery of which is fitted exactly inside the bore 3 into which the hub may subsequently be fixed rigidly. This hub 6 likewise has preferably on its periphery three indentations 7 located each opposite one of the indentations 4. The hub 6 thus forms a kind of three-armed star which can be fitted accurately inside the plate. It includes in addition a central bore 8 which enables it to be mounted rigidly by, for example, close fitting onto the spindle 9 which in the usual way revolves in a fixed support 10 by means of bearings 11 and is drilled with an axial passage 12 or with two axial passages 12 and 13. A yarn-guide 14 is arranged at the outlet from a yarn-guide duct consisting of an opening 15 machined in the base 2 of the plate 1 and continuing into an opening 16 machined in one of the arms of the star 6 and connected to the axial passages 12 and 13.

Furthermore the end journal 17 of the spindle 9 has a bearing 18 thanks to which the spindle revolves inside the spool-carrier 19.

In addition to this centred revolving assembly the mechanism includes an offset revolving assembly consisting in the configuration represented, of two parts 20 and 21 connected together along a plane 22 perpendicular to the axis of the assembly. Each of these parts includes a tubular journal 22 or 23 respectively, the central passage in which serves as clearance for the spindle 9 and the periphery of which revolves in bearings 24 and 25 respectively, the one mounted in the base of the spool-carrier 19 and the other in the fixed support 10.

At the two facing ends of the parts 20 and 21 the tubular journals 22 and 23 expand into a wall which is conical, 26 or 27, then cylindrical, 28 and 29 respectively, at the same time as the assembly of these expanded portions is notched by three wide indentations 30 which are, for example, cylindrical, as may be seen in particular in FIG. 2. These indentations notched the two conical portions 26 and 27 and leave no more in existence of the peripheral portions 28 and 29 than three connecting sectors 31 along which the mechanical connection between the two parts 20 and 21 is effected.

Into each of the re-entrant teeth 5 of the centred assembly is fixed a fastener spur 32 directed upwards toward the spool carrier 19 as shown in the lefthand portion of FIG. 1, whilst in each of the sectors 31 is likewise fixed a fastener spur 33 likewise directed upwards toward the spool carrier 19. As shown in the drawings, the fastener spurs 32 and 34 are all concentrically arranged and circumferentially spaced outside the sleeve formed by parts 20 and 21. This enables there to be placed over and engaged with the whole of the six fastener spurs 32 and 33 an annular elastic part 34 which interconnects the centered assembly and the offset assembly for concurrent rotation. The elastic part 34, as may be seen in particular in FIG. 4 has six apertures thanks to which the part is mounted on the six spurs. The fastener spurs 32 for the annular elastic part 34 on the centred assembly may if necessary be fixed directly onto the arms of the hub 6. The spurs have a suitable shape enabling easy mounting and dismounting of the annular elastic part 34.

The inner perimeter of the part 34 is preferably such that it enables the part to be passed over the periphery of the spool carrier 19 and the support 35 which fastens the bearing 24 to the base of the spool-carrier 19. In this way the whole of the annular elastic part 34 may be easily withdrawn by simple pulling and replaced by a new part without necessitating any dismantling of the remainder of the mechanism. External tabs 36 at the edge of each aperture for mounting facilitate handling.

Figures 3, 4:
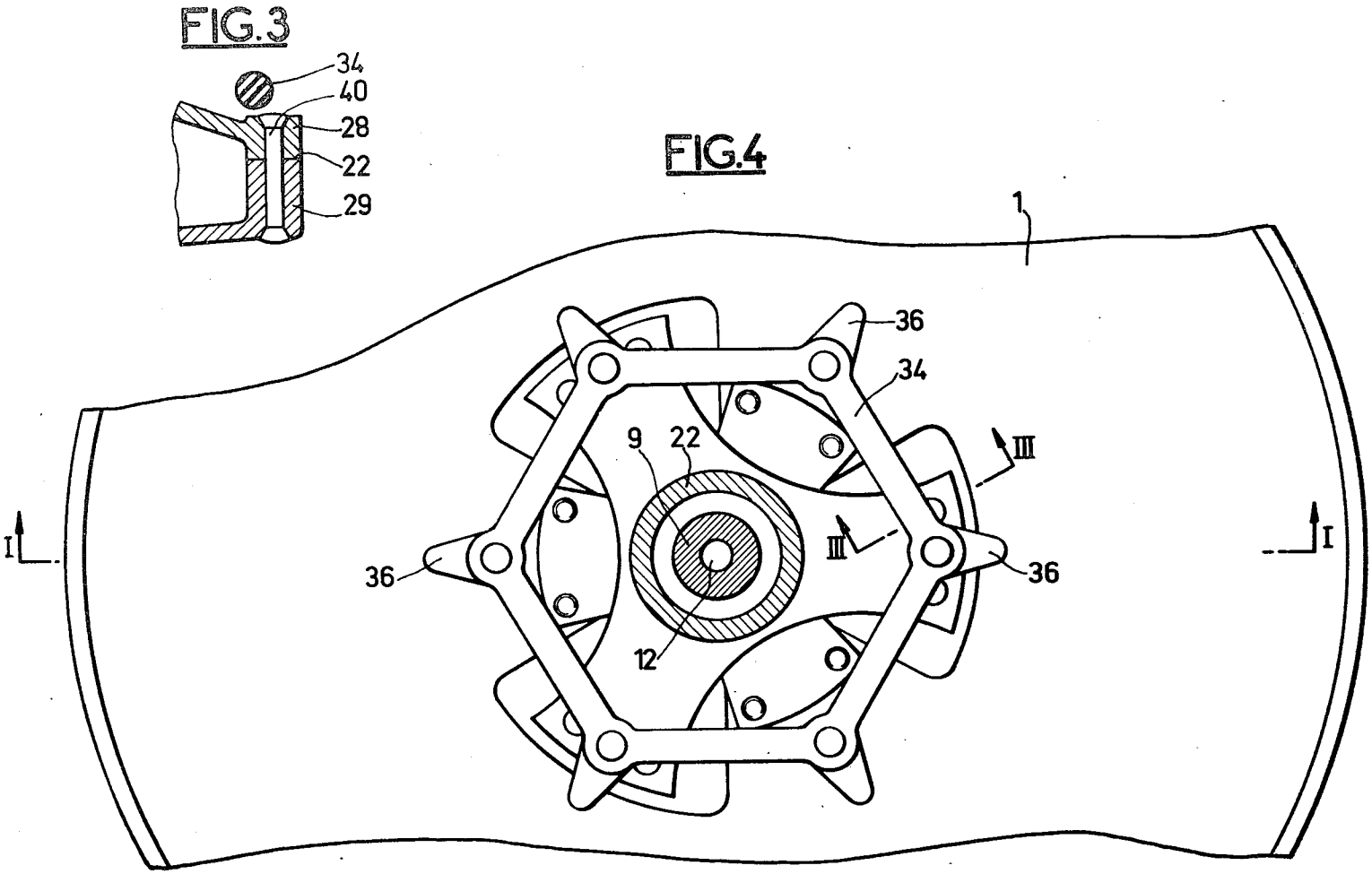
FIG. 3 is a partial axial section along III—III in FIG. 4.
FIG. 4 is a cross-section along IV—IV in FIG. 1, of the assembly likewise assumed not offset.
Figure 5:
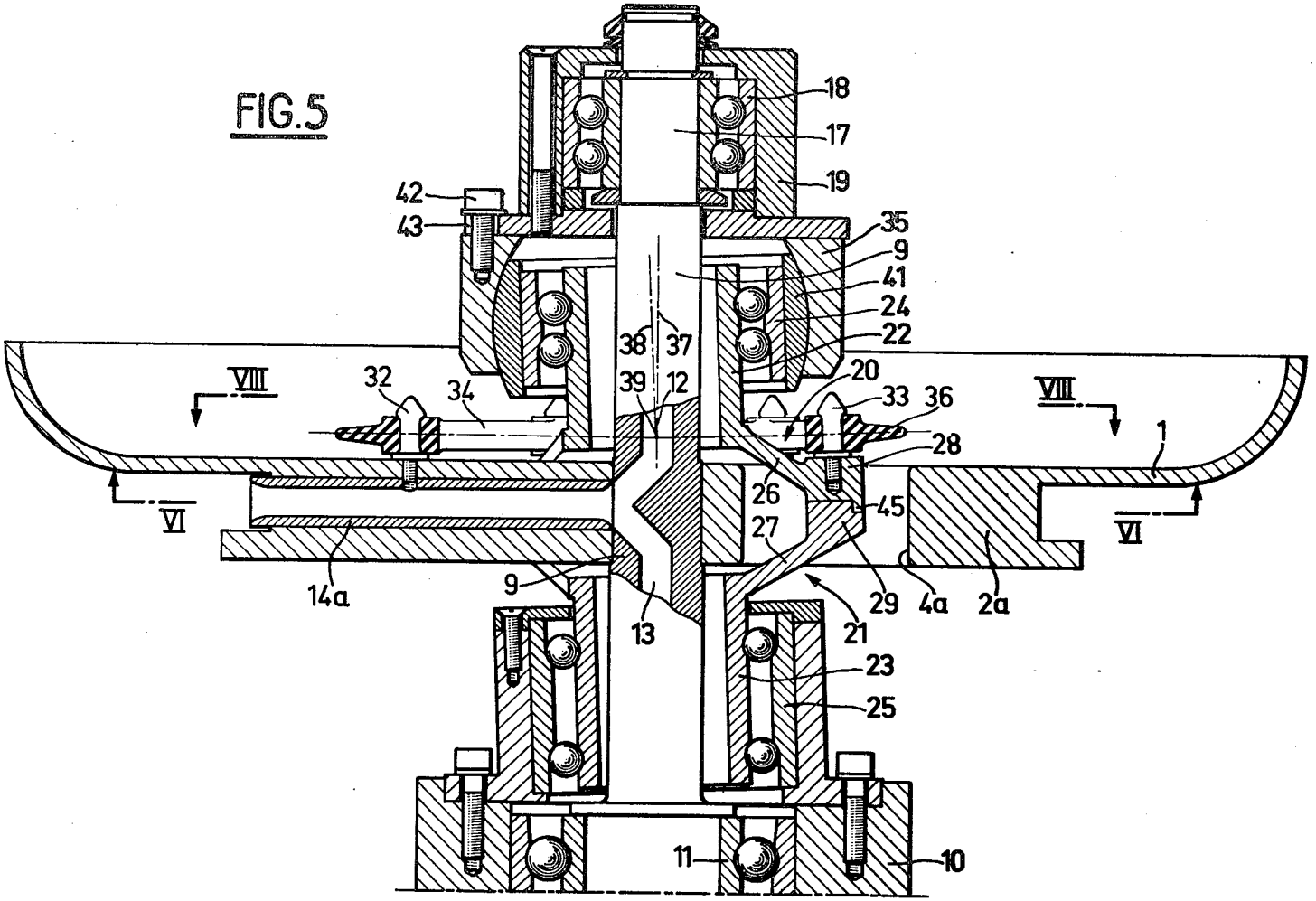
FIG. 5 represents the second variant in axial section along V—V in FIG. 8.
Figure 6:
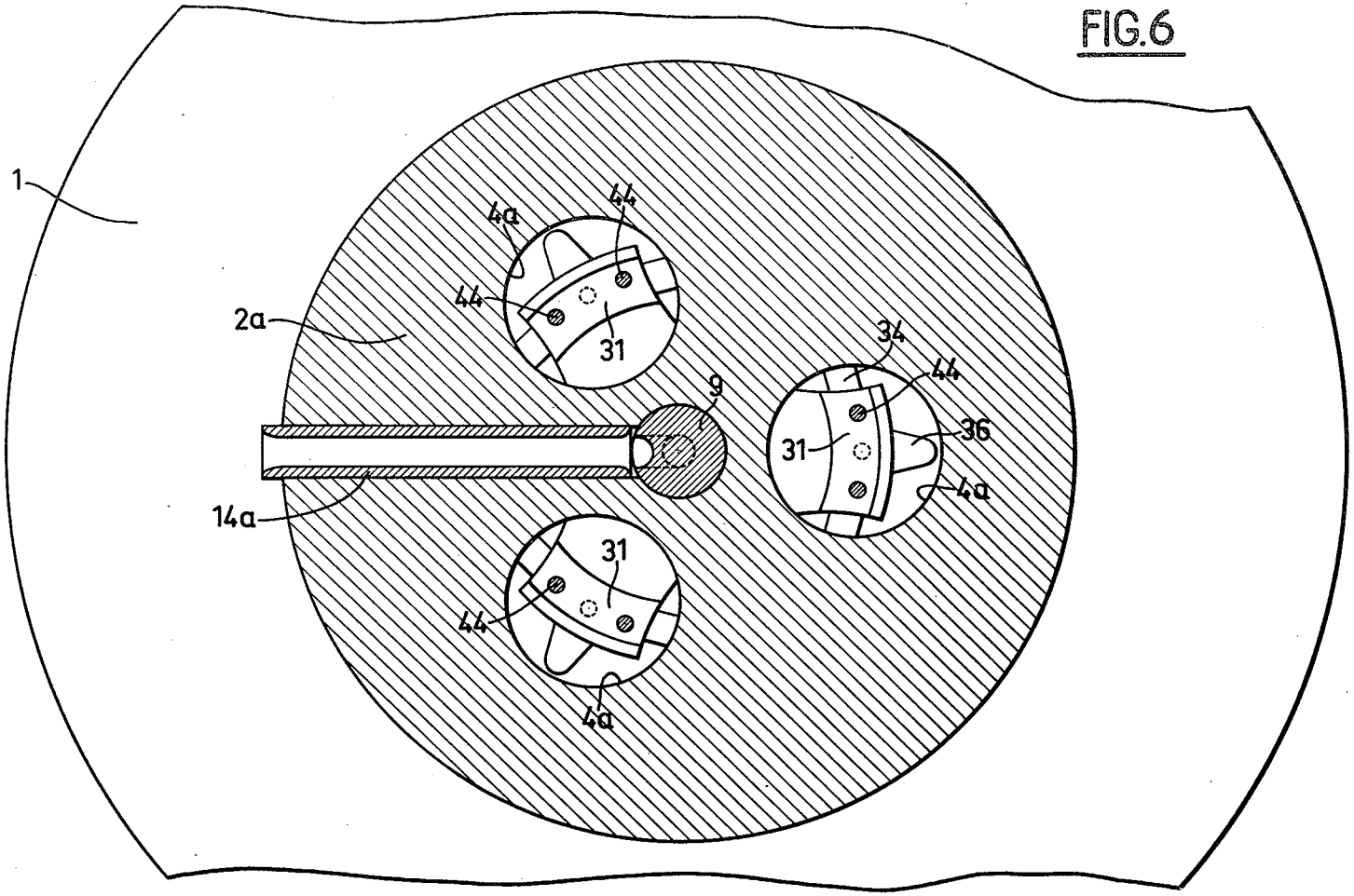
FIG. 6 is a cross-section along VI—VI in FIG. 5, the upper part of the offset assembly being assumed removed.
Figure 8:
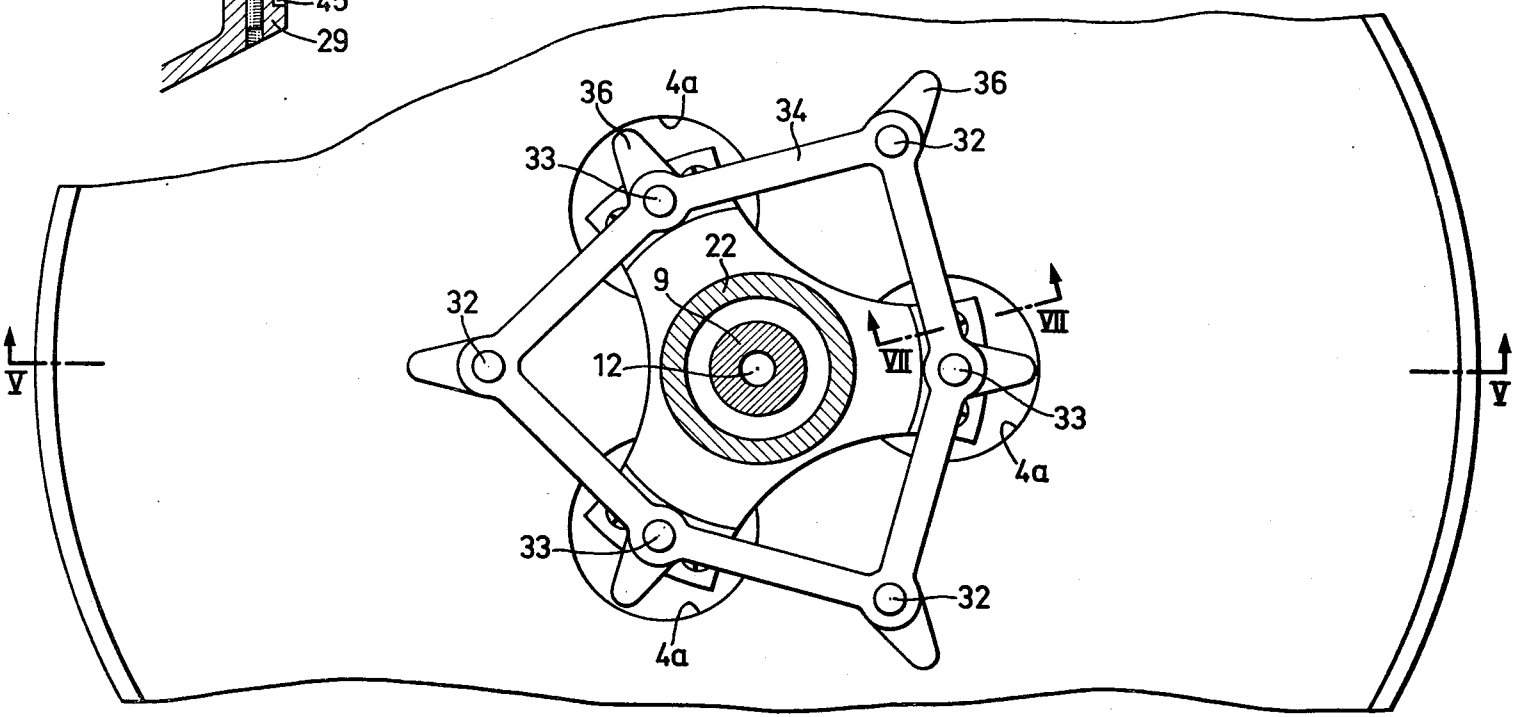
FIG. 8 is a cross-section along VIII—VIII in FIG. 5, of the assembly assumed not offset.
Figure 7:
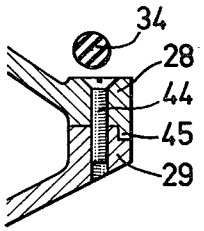
FIG. 7 is a partial axial section along VII—VII in FIG. 8.

In particular the part 34 may advantageously have the configuration of a regular hexagon as shown in FIG. 4, by arranging for that purpose all of the spurs 32 and 33 at the same distance from the axis. Naturally the number of notches, arms and spurs of each kind might differ from 3.

It goes without saying that without departing from the scope of the invention the section of the elastic part 34 which is shown as substantially circular in FIG. 3 may just as well be elliptical, square or rectangular. In the latter case it may be a matter of a simple diaphragm (the shape of which, seen from above, remains the same as that shown in FIG.4) obtained not by moulding as for the preceding shapes but by cutting out.

In order to reduce to a minimum the elastic working of the part 34 during the course of rotation it is preferable that the axis 37 of the spindle 9 and of the centred assembly and the axis 38 of the offset assembly intersect preferably at a point 39 located as near as possible to the mean plane of the part 34, and consequently the yarn-guide duct 15–16 becomes offset below this plane, the central clearnace hole of the tubular journal 23 being consequently determined in order not to foul the spindle 9.

For manufacture of the assembly of the sleeve in accordance with the invention when it is in two pieces and in order to avoid extremely close manufacturing tolerances on the pieces, the pieces 20 and 21 are first of all produced in the manner indicated, then they are assembled definitely together by accurate grinding of their plane 22 and by definite fastenings consisting, for example, of rivets 40 as may be seen in FIGS. 2 and 3. The assembly is next machined to a finish as a single piece, especially for the grinding of the outer cylindrical portions of the tubular journals 22 and 23 when these portions must be mounted in conventional bearings. If these journals constitute on their own the inner races of integrated bearings as in the example represented in FIG. 1, the same goes for the grinding of the necks acting as races. Hence the whole is mounted on an outside grinder and machined with precision and in a perfectly centred way which avoids any misalignment between the two journals 22 and 23.

This is possible thanks to the fact that the star shape of the central hub 6 with its indentations 7 is determined so that this hub may be introduced subsequently between the sectors 31 of the offset assembly. It is then sufficient next to fit and fix the hub 6 in the bore 3 in the plate, then to fit the spindle 9 into the hub 6 after having put in place the various bearings. The elastic ring 34 may according to what was said above be introduced at the last moment and may be withdrawn and exchanged at any time without any dismantling. It should be observed that in the case where the offset sleeve is in one single piece, production, setting aside the operations of machining of the plane 22 and of assembly of the two portions, which have no longer been carried out, is identical with that which has been described previously.

In order to eliminate on the other hand the problems of tolerances connected with the slope of the axis of the two bearings 24 and 25, the bearing 25 preferably consists of a bearing constituting a footing, either with two spaced rings of rolling parts or else a bearing of the type having an integrated cheek and having oblique O contacts, and the bearing 24 is preferably mounted so as to be able both to slide axially and to orientate itself in the manner of a ball joint. In the example represented in FIG. 1 the bearing 24 is of the integrated type with its outer race having a cylindrical periphery which slides with minimum clearance in a socket 41 the outer surface of which is spherical in order to be articulated in the manner of a ball joint inside the support 35. As a variant it is likewise possible to employ a bearing the outer race of which has a spherical internal bearing surface for the balls and the cylindrical external surface of which slides in the support.

In addition, this support 35 is fixed into the base of the spool-carrier 19 by means of screws 42 which are screwed, for example, into the support 35, pasing through slots 43 machined in the base of the spool-carrier 19. In accordance with the invention, these slots are sufficiently wide to enable lateral adjustment of the assembly. In this way, after having mounted the whole of the mechanism in the manner indicated but without locking the screws 42 in order to allow relative sideways movement of the parts 35 and 19, the whole of the mechanism is caused to revolve at a suitable speed while holding the spool-carrier 19, which produces automatically the horizontal location of the support 35 and the axial location of the journal 22 with respect to this support thanks to the possibility of sliding as indicated. It is only after a few moments of operation that the screws 42 are locked, which then enables the mechanism to be fixed with great accuracy without having had to demand extremely accurate tolerances upon the axial distances and the angular positionings which result from the accumulation of a large number of tolerances.

In the variant as FIGS. 5 to 8 the main difference with respect to the preceding variant is that the plate previously referenced 2 as well as the hub previously referenced 6 are replaced by a single piece 2*a*. Similarly the previous indentations 4 in the plate and 7 in the hub are replaced by single openings 4*a* of any section, for example, circular of dimensions sufficient to enable the sectors 31 to pass through without contact.

Per contra the assembly of the parts 20 and 21 together, which constitute the offset assembly, is no longer carried out in a permanent manner by means of rivets 40 but on the contrary in a dismountable manner by means of screws 44 as seen in FIGS. 2 and 3. The offset revolving assembly 20–21 may as previously be machined to a finish as a whole after mounting by means of the screws 44, but it may then be dismounted for assembly of the complete mechanism. In order that the two pieces resume exactly the same relative positions with respect to one another after dismounting and remounting, it is necessary to provide means of accurate centreing which consist, for example, of a concentric rim 45 on each sector of the portion 28 fitting against corresponding grooving of each sector of the portion 29, or else by means of centreing feet which are not shown but which are conventional artifices.

In the case of the first variant, when the centred assembly is in two portions and the offset assembly in one portion, conditions are imposed as has been seen upon the dimensions of the hub and of its indentations in order to enable introduction of the hub through the indentations of the offset assembly. On the contrary in accordance with the second variant where the centred assembly is in one single piece and the offset assembly in two separable pieces, no particular condition is imposed inasmuch as the two portions 20 and 21 of the offset assembly can always be assembled by bringing them together axially until they come to meet at their sectors on the portions 28 and 29 respectively inside the openings 4*a*. One may take advantage of it as appears in the Figures, to reduce the maximum diameter of the central expansion of the offset assembly.

Consequently the fastener parts 33 carried by these sectors are closer to the axis but it is possible per contra to move the fastener parts 32 carried by the plate 2*a* slightly further away in order to preserve the same perimeter for the whole of the elastic part 34 the outline of which, instead of being a regular hexagon, becomes an irregular hexagon which can go as far as a triangle. Thus the same facility of sideways mounting and dismounting of this elastic part is preserved, by passing round the upper bearing 35. Moreover the radial yarn-guide is replaced by a single part 14*a* fitted into a radial drilling in the single part 2*a*. The manufacture and the mounting of this twister mechanism are hence relatively simpler whilst preserving the same advantages, naturally subject to the accuracy of the reassembly of the two portions of the offset assembly.

We claim:

1. A twister mechanism, comprising, a first revolving assembly including a spindle rotatable about a spindle axis, a second revolving assembly including a sleeve located in spaced relation around said spindle, said second revolving assembly being supported for rotational movement about a second axis which is oblique with respect to the spindle axis, elastic means connecting said first and second assemblies together for concurrent rotation, a spool carrier, a bearing connecting said spool carrier to said first revolving assembly, and a bearing connecting said spool carrier to said second revolving assembly to prevent rotation of said spool carrier, said first revolving assembly having portions which extend radially through said second revolving assembly and are separated by indentations, said second revolving assembly having circumferentially spaced sectors with portions which extend into said indentations, a first set of circumferentially spaced fastening means on said first assembly at a location radially outside said sleeve, a second set of circumferentially spaced fastening means on said second assembly externally of said sleeve, said elastic means connecting said first set and said second sets of fastening means.

2. The twister mechanism of claim 1 wherein said spindle axis and said second axis intersect at a point located at substantially the same axial location as said elastic means, said first set of fastening means being disposed in substantial concentricity with said second set of fastening means.

3. The twister mechanism of claim 1 wherein said fastening means face toward said spool carrier to permit a replacement elastic means to be installed by passing it over said spool carrier and into engagement with the respective fastening means.

4. The twister mechanism of claim 1 wherein said portions of said second assembly extend axially through said indentations.

5. A twister mechanism according to claim 1 wherein the first revolving assembly includes a central hub on said spindle, and a plate having a bore engaged with and supported by the periphery of said hub, said indentations being located between aid hub and said plate, said first set of fastening means being located between said indentations in circumferential alignment therewith.

6. The twister mechanism of claim 1 wherein the first revolving assembly includes a hub having a size and shape which is passable into said second revolving assembly between the sectors.

7. The twister mechanism of claim 1 wherein the elastic means is an annular elastic member provided with internal dimensions which enable it to be introduced and withdrawn by passing it around said spool carrier and said bearings.

8. The twister mechanism of claim 1 wherein the elastic means is an annular elastic member and the fastening means are spurs which engage said elastic member.

9. The twister mechanism of claim 1 wherein the elastic means has a mean plane which is substantially at the level of the point of convergence of the two axes of the two revolving assemblies, said first revolving assembly including a central hub and a plate supported on said central hub, a radial yarn-guide duct extending through the plate and the central hub, below the means plane of the elastic means.

10. The twister mechanism of claim 1 having a fixed support, a bearing connecting one end of the second revolving assembly to the fixed support, a ball joint connected to said spool carrier, said second revolving assembly having its other end supported by and axially movable in said ball joint, said ball joint being movable relative to said spool carrier in directions perpendicular to said second axis to permit relative displacement during assembly of the twister mechanism.

11. The twister mechanism of claim 1 wherein the first revolving assembly includes a hub and a plate united into a single piece, said indentations being formed by apertures of closed outline between the plate and the hub, said second revolving assembly including two separable pieces which are connected together at the level of said sectors.

* * * * *